US011331922B2

(12) United States Patent
Kobayashi

(10) Patent No.: US 11,331,922 B2
(45) Date of Patent: May 17, 2022

(54) LIQUID CONTAINER AND LIQUID DISCHARGE APPARATUS

(71) Applicant: Ricoh Company, Ltd., Tokyo (JP)

(72) Inventor: Takeyuki Kobayashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/952,633

(22) Filed: Nov. 19, 2020

(65) Prior Publication Data

US 2021/0178773 A1 Jun. 17, 2021

(30) Foreign Application Priority Data

Dec. 17, 2019 (JP) ..... JP2019-227376

(51) Int. Cl.
*B41J 2/175* (2006.01)

(52) U.S. Cl.
CPC ..... *B41J 2/17509* (2013.01); *B41J 2/17563* (2013.01); *B41J 2/17566* (2013.01); *B41J 2/17596* (2013.01)

(58) Field of Classification Search
CPC .... B41J 2/175; B41J 2/17506; B41J 2/17509; B41J 2/17513; B41J 2/17526; B41J 2/17563; B41J 2/17566; B41J 2/17596; B41J 29/02; B41J 29/13
See application file for complete search history.

(56) References Cited

U.S. PATENT DOCUMENTS 5,886,721 A * 3/1999 Fujii ..... B41J 2/17513 347/87
6,058,984 A * 5/2000 Sato ..... B41J 2/17506 141/13
2004/0017448 A1* 1/2004 Murakami ..... B41J 2/17509 347/86
2005/0134661 A1* 6/2005 Miyazawa ..... B41J 2/18 347/86
2007/0109365 A1* 5/2007 Okuda ..... B41J 2/17563 347/85
2007/0139492 A1* 6/2007 Anderson ..... B41J 2/17506 347/86
2012/0306950 A1 12/2012 Kobayashi et al.
2013/0044148 A1 2/2013 Kobayashi
2013/0057604 A1 3/2013 Masunaga et al.
2013/0127937 A1 5/2013 Masunaga et al.
2013/0135368 A1 5/2013 Kobayashi et al.
2013/0135401 A1 5/2013 Kobayashi et al.
(Continued)

FOREIGN PATENT DOCUMENTS

JP 2012-240284 12/2012
JP 2017-087678 5/2017

*Primary Examiner* — Anh T Vo
(74) *Attorney, Agent, or Firm* — Xsensus LLP

(57) ABSTRACT

A liquid container configured to store a liquid to be supplied to a liquid discharge head, the liquid container includes a tank case, a first container in the tank case, the first container configured to store the liquid, a second container, separated from the first container, in the tank case, the second container configured to store the liquid, a communication channel connecting the first container and the second container, a first valve configured to open when the liquid is fed to the first container, and a second valve configured to open when the liquid is discharged from the second container.

15 Claims, 15 Drawing Sheets

(56) References Cited

U.S. PATENT DOCUMENTS

| | | | |
|---|---|---|---|
| 2013/0147867 | A1 | 6/2013 | Kobayashi et al. |
| 2015/0158308 | A1 | 6/2015 | Kobayashi et al. |
| 2017/0136778 | A1 | 5/2017 | Kobayashi et al. |
| 2018/0170087 | A1 | 6/2018 | Kobayashi et al. |

* cited by examiner

REVERSE FEED

LIQUID FEED

LIQUID CONTAINER AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-227376, filed on Dec. 17, 2019, in the Japan Patent Office, the entire disclosures of which is hereby incorporated by reference herein.

BACKGROUND

Technical Field

Aspect of this disclosure relates to a liquid container and a liquid discharge apparatus.

Related Art

A liquid discharge apparatus includes a sub tank (head tank) and a main tank. The sub tank serves as a liquid container to store a liquid to be supplied to a liquid discharge head. The main tank stores the liquid to be supplied to the sub tank.

The liquid in the sub tank is reversely fed to the main tank and is further fed from the main tank to the sub tank while an air release valve is closed to agitate the liquid in the sub tank.

SUMMARY

In an aspect of this disclosure, a liquid container configured to store a liquid to be supplied to a liquid discharge bead, the liquid container includes a tank case, a first container in the tank case, the first container configured to store the liquid, a second container, separated from the first container, in the tank case, the second container configured to store the liquid, a communication channel connecting the first container and the second container, a first valve configured to open when the liquid is fed to the first container, and a second valve configured to open when the liquid is discharged from the second container.

In another aspect of this disclosure, a liquid discharge apparatus includes a liquid discharge head configured to discharge a liquid, a liquid container configured to store a liquid to be supplied to the liquid discharge head, and a main tank configured to store the liquid to be supplied to the liquid container. The liquid container includes a tank case, a first container in the tank case, the first container configured to store the liquid, a second container, separated from the first container, in the tank case, the second container configured to store the liquid, a communication channel connecting the first container and the second container, a first valve configured to open when the liquid is fed to the first container, and a second valve configured to open when the liquid is discharged from the second container.

BRIEF DESCRIPTION OF THE SEVERAL VIEWS OF THE DRAWINGS

The aforementioned and other aspects, features, and advantages of the present disclosure will be better understood by reference to the following detailed desorption when considered in connection with the accompanying drawings, wherein.

Figure 1:
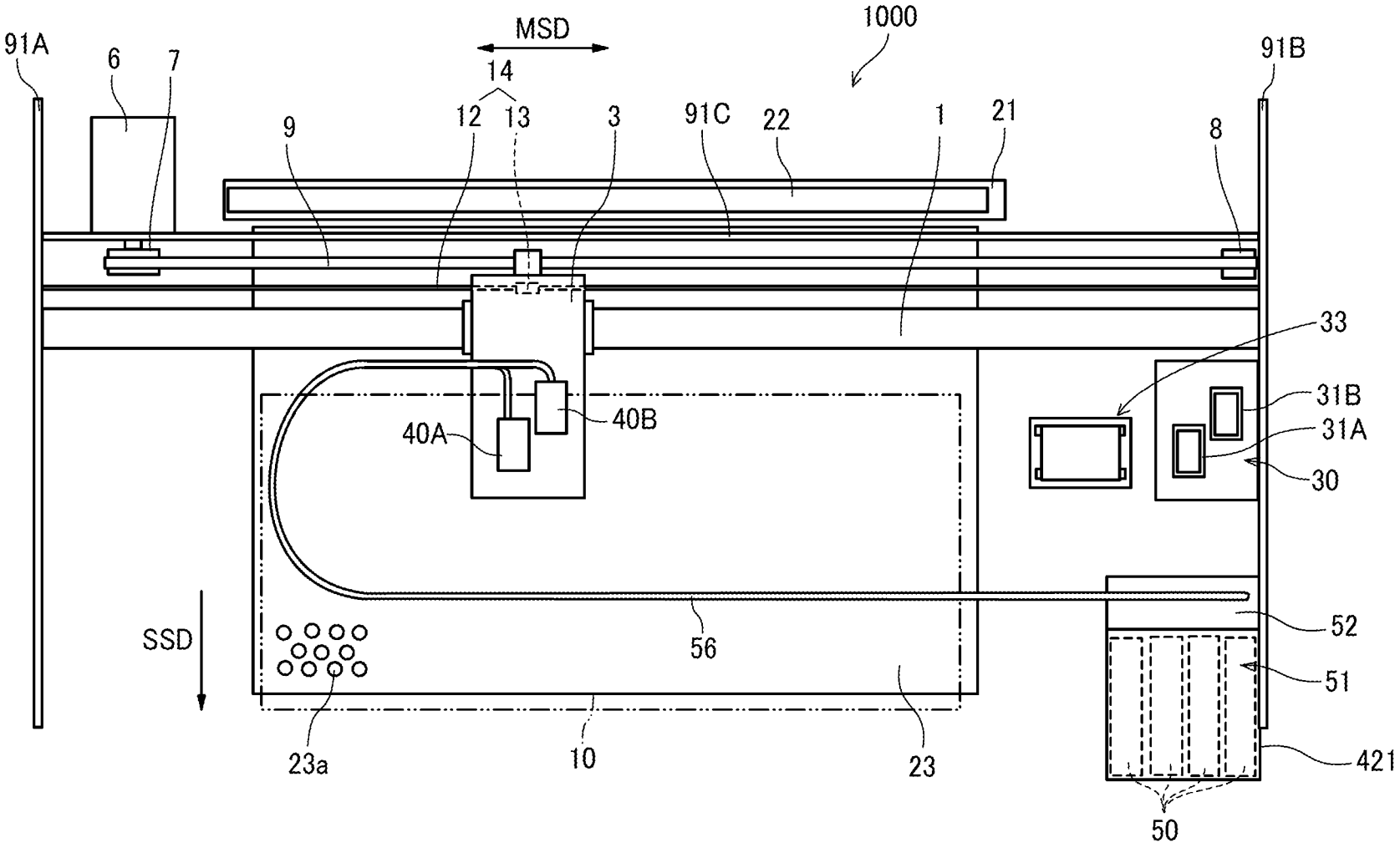
FIG. 1 is a schematic plan view of a mechanism of an example of the liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular finials "a," "an," and "the" are intended to include the plural forms as well, unless the context clearly indicates otherwise.

Figure 2:
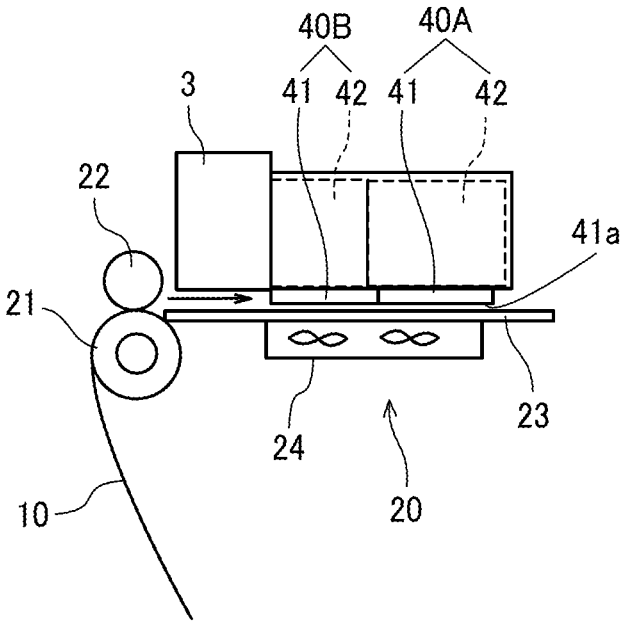
FIG. 2 is a schematic side view of a portion of the liquid discharge apparatus of FIG. 1.

Referring now to the drawings, wherein like reference numerals designate identical or corresponding parts throughout the several views, embodiments of the present disclosure are described below. A liquid discharge apparatus 1000 according to a first embodiment of the present disclosure is described in detail below with reference to FIGS. 1 and 2. FIG. 1 is a schematic plan view of a mechanism of the liquid discharge apparatus 1000. FIG. 2 is a schematic side view of a portion of the liquid discharge apparatus 1000.

The liquid discharge apparatus 1000 is a serial-type printer. A main guide 1 is bridged between a left-side plate 91A and a right-side plate 91B. The main guide 1 hold the carriage 3 so that the carriage is reciprocally movable in a main-scanning direction indicated by arrow "MSD" in FIG. 1. The carriage 3 is reciprocally moved in the main-scanning direction MSD by a main-scanning motor 6 via a timing belt 9 bridged between a drive pulley 7 and a driven pulley 8. The main-scanning motor 6, the timing belt 9, drive pulley 7, and the driven pulley 8 form a main-scan moving mechanism held at a rear plate 91C.

Two discharge devices 40A and 40B are mounted on the carriage 3. Hereinafter, the discharge devices 40A and 40B are simply and collectively referred to as the "discharge device 40." Each of the discharge device 40 includes a liquid discharge head 41 and a sub tank 42. The liquid discharge head 41 serves as a liquid discharger. The sub tank 42 serves as a liquid container according to the first embodiment of the present disclosure to supply liquid to the liquid discharge head 41. The liquid discharge head 41 and the sub tank 42 form the liquid discharge device 40 as a single unit. Hereinafter, the liquid discharge head 41 is simply referred to as a "head 41."

A cartridge holder 51 is disposed at an apparatus body of the liquid discharge apparatus 1000. Main tanks 50 (liquid cartridges) to contain liquid of the respective colors are detachably attached to the cartridge holder 421. The cartridge holder 51 includes a liquid feed pump unit 52 to supply liquid of the respective colors from the main tanks 50 to the sub tanks 42 via a liquid path 56 (also referred to as a "liquid tube") of the respective colors.

An encoder scale 12 having a specific pattern on a surface of the encoder scale is stretched between the left-side plate 91A and the right-side plate 91B along the main-scanning direction MSD of the carriage 3. The carriage 3 includes an encoder sensor 13 formed of a transmissive photosensor that reads the predetermined pattern on the encoder scale 12. The encoder scale 12 and the encoder sensor 13 configure a linear encoder 14 that detects a movement of the carriage 3.

Further, the liquid discharge apparatus 1000 includes a conveyor 20 to attract a sheet 10 and convey the sheet 10 opposite to the head 41 to convey the sheet 10 in a sub-scanning direction indicated by arrow SSD in FIG. 1. The sub-scanning direction SSD is also referred to as a "conveyance direction."

The conveyor 20 includes a conveyance roller 21, a pressure roller 22, a platen 23, and a suction mechanism 24 (see FIG. 1). The pressure roller 22 contacts the conveyance roller 21 and applies a pressure onto the conveyance roller 21. The platen 23 faces the head 41 to guide a sheet 10. The suction mechanism 24 attracts the sheet 10 through suction holes 23 *a* of the platen 23. The platen 23 includes suction holes 23*a* formed all over an entire surface of the platen 23. Although only a portion of the suction holes 23*a* is illustrated in FIG. 1 the platen 23 includes suction holes 23*a* formed all over an entire surface of the platen 23.

The liquid discharge apparatus 1000 includes a maintenance unit 30 to maintain and recover a discharge function the head 41. The maintenance unit 30 is disposed on one side (right-side in FIG. 1) of the liquid discharge apparatus 1000 in the main-scanning direction MSD of the carriage 3. The maintenance unit 30 includes, for example, caps 31A and 31B to cap nozzle surfaces 41*a* of the heads 41 and a wiper 33 to wipe the nozzle surfaces 41*a*. The nozzle surface 41*a* is a surface of the head 41 on which the nozzles are formed as illustrated in FIG. 1. The caps 31A and 31B are collectively referred to as "caps 31."

The liquid discharge apparatus 1000 conveys the sheet 10 along the platen 23 in the sub-scanning direction SSD by the conveyance roller 21 and the pressure roller 22 while attracting the sheet 10 onto the platen 23. The sub-scanning direction SSD is also referred to as a "conveyance direction."

The head 41 is driven in response to print signals while the carriage 3 moves in the main-scanning direction MSD, to discharge the liquid of a desired color to the sheet 10 stopped, thus printing one line of an image on the sheet 10. Then, the sheet 10 is fed by a predetermined distance to print next line of the image. The above-described operations of feeding and printing are repeated to form a desired image on the sheet 10, and then the sheet 10 is ejected (conveyed) in the sub-scanning direction SSD.

Figure 3:
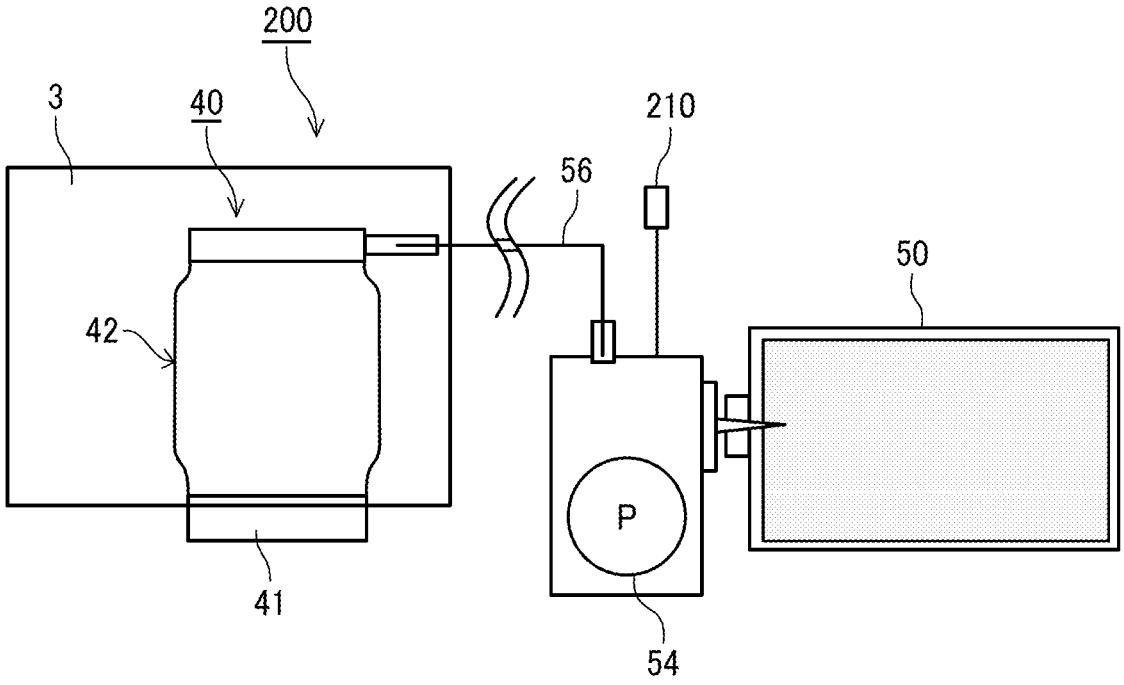
FIG. 3 is a schematic cross-sectional side view of a liquid supply system of the liquid discharge apparatus according to the first embodiment of the present disclosure.

Next, a liquid supply system 200 to supply a liquid to the head 41 in the liquid discharge apparatus 1000 according to the first embodiment is described with reference to FIG. 3. FIG. 3 is a schematic cross-sectional side view of a liquid supply system 200 of the liquid discharge apparatus 1000 according to the first embodiment of the present disclosure.

The liquid supply system 200 includes sub tank 42 (head tank), the main tank 50, the liquid path 56 (liquid tube) a liquid feed pump 54, and a controller 210 (circuitry). The sub tank 42 temporality store a liquid to be supplied to the head 41. The main tank 50 serves as the liquid container to store a liquid to be supplied to the sub tank 42. The liquid path 56 is disposed between the main tank 50 and the sub tank 42 to connect the main tank 50 and the sub tank 42.

The liquid supply system 200 includes the liquid feed pump 54 serving as a reversible liquid feed device that can feed a liquid from the main tank 50 to the sub tank 42 and can reversibly feed a liquid from the sub tank 42 back to the liquid path 56 (including the main tank 50). The controller 210 controls the liquid feed pump 54 and drives the liquid feed pump 54 in one of a forward direction (from main tank 50 to sub tank 42) and a reverse direction (from sub tank 42 to main tank 50).

Figure 4:
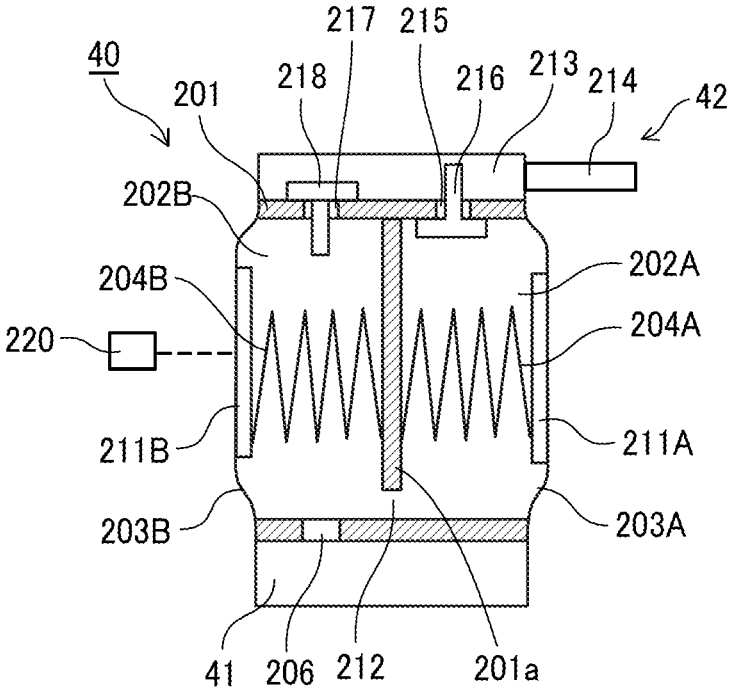
FIG. 4 is a schematic partial cross-sectional side view of a discharge device including a sub tank (liquid container) according to the first embodiment of the present disclosure.

Next, a sub tank 42 (liquid container) according to a first embodiment of the present disclosure is described with reference to FIG. 4. FIG. 4 is a schematic partial cross-sectional side view of the discharge device 40 including the sub tank 42.

The sub tank 42 includes two liquid containers 202 to store liquids in a tank case 201. The tank case 201 is a main body of the liquid container. The liquid containers 202 include a first container 202A and a second container 202B.

The tank case 201 includes openings on both sides (left side and right side in FIG. 4) and a partition wall 201*a* in a center of the tank case 201. Each opening of the tank case 201 is sealed with a flexible film 203 serving as a flexible member. The flexible film 203 includes a flexible film 203A and a flexible film 203B.

Thus, the tank case 201 includes the first container 202A and the second container 202B, one surface of which is formed of the flexible films 203A and 203B, respectively. The partition wall 201*a* separates the tank case 201 into the first container 202A and the second container 202B.

A restoring force of the negative-pressure forming spring 204 (204A and 204B) as an elastic member in the tank case 201 constantly pushes each flexible film 203 outward of the tank case 201. The sub tank 42 further includes reinforcement members 211A and 211B to respectively receive one end of negative-pressure forming springs 204A and 204B. The reinforcement members 211A and 211B are respectively fixed to the flexible films 203A and 203B.

Thus, a decrease in an amount of liquid remained in each of the first container 202A and the second container 202B generates negative pressures in the first container 202A and the second container 202B since the restoration forces of the negative-pressure forming springs 204 respectively act on the flexible films 203A and 203B that form flexible (deformable) walls of the tank case 201.

The first container 202A and the second container 202B are communicated with each other by a communication channel 212 formed on a lower end (bottom end) of the partition wall 201*a* in the tank case 201.

Thus, the sub tank 42 includes a partition wall 201*a* separating the first container 202A and the second container 202B. The partition wall 201*a* includes the communication channel 212. The communication channel 212 is on a bottom part of the partition wall 201*a*.

Further, the sub tank 42 includes an agitation channel 213 in a top part (upper part) of the tank case 201. The agitation channel 213 is connected to the liquid path 56 communicating with the main tank 50 via a joint 214 or the like.

Liquid is supplied from the agitation channel 213 to the first container 202A via a supply port 215. The sub tank 42 includes a first valve 216 on a supply port 215 to open and close the discharge port 217. The first valve 216 opens the discharge port 217 when the liquid is fed from the agitation channel 213 to the first container 202A.

Liquid is discharged from the second container 202B to the agitation channel 213 via the discharge port 217. The sub tank 42 includes a second valve 218 on a discharge port 217 to open and close the discharge port 217. The second valve 218 opens the discharge port 217 when the liquid is discharged from second container 202B to the agitation channel 213.

The tank case 201 includes a head supply port 206 to supply a liquid from the second container 202B to the head 41.

The sub tank 42 includes a displacement detector 220 to detect a displacement (deformation) of the flexible film 203.

Next, an agitation operation of the sub tank 42 according to the first embodiment pf the present disclosure is described with reference to FIGS. 5A to 5F. FIGS. 5A to 5F are schematic cross-sectional side view of the sub tank 42 illustrating the agitation operation of the sub tank 42.

Figure 5A:
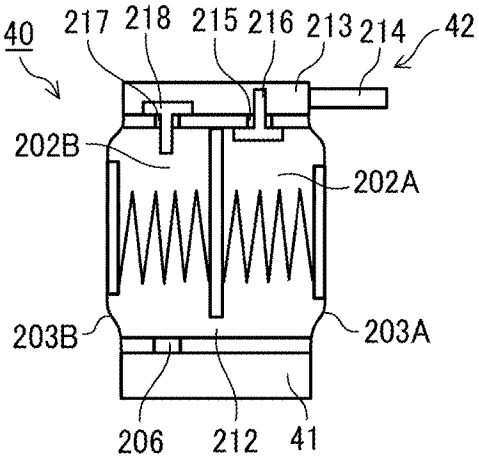
FIGS. 5A to 5F are schematic cross-sectional side view of the sub tank illustrating an agitation operation of the sub tank.
Figure 5B:
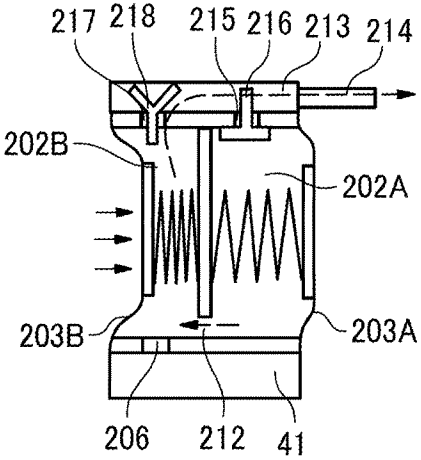

The controller 210 drives the liquid feed pump 54 in the reverse direction to suck the liquid from the agitation channel 213 of the sub tank 42 as illustrated in FIG. 5B from a state illustrated in FIG. 5A. In FIG. 5B, the first valve 216 closes and the second valve 218 opens, so that the liquid in the second container 202B passes through the discharge port 217 to the agitation channel 213 and is transferred to the liquid path 56 as indicated by arrow in FIG. 5B.

Figure 5C:
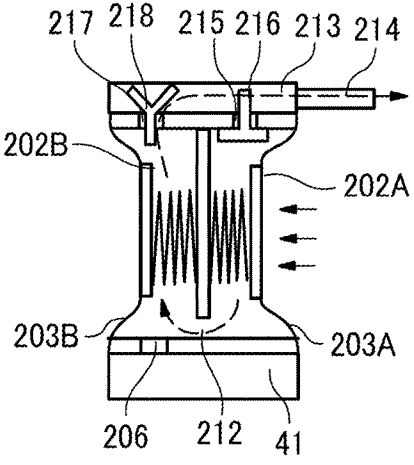

When the controller 210 continuously drives the liquid feed pump 54 in the reverse direction to further suck the liquid from the agitation channel 213 from a state as illustrated in FIG. 5B, the liquid in the first container 202A is transferred to the second container 202B via the communication channel 212, discharged from the second container 202B to the agitation channel 213, and transferred to the liquid path 56 as illustrated in FIG. 5C.

Figure 5D:
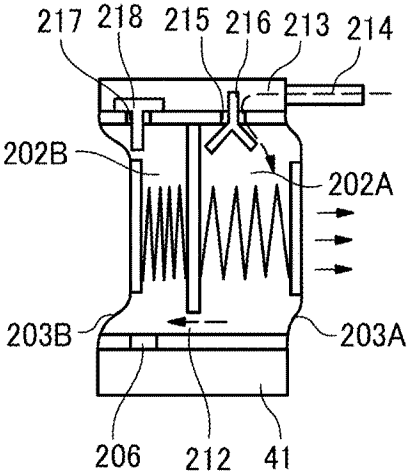

Then, the controller 210 drives the liquid feed pump 54 in the forward direction to feed the liquid to the agitation channel 213 of the sub tank 42 as illustrated in FIG. 5D. Then, the first valve 216 opens and the second valve 218 closes, so that the liquid is transferred to the first container 202A via the supply port 215 as indicated by arrow in FIG. 5D.

Figure 5E:
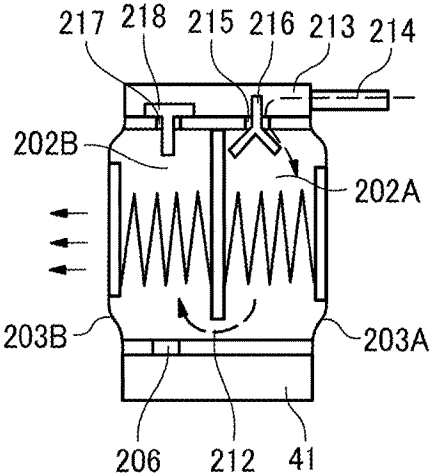

When the controller 210 continuously drives the liquid feed pump 54 in the forward direction to further transfer the liquid from the agitation channel 213 to the first container 202A, the liquid in the first container 202A is transferred to the second container 202B via the communication channel 212 as illustrated in FIG. 5E.

The above-described operations are repeated once or a plurality of times, so that a liquid, in which sedimented components of the liquid has settled on each bottoms of the first container 202A and the second container 202B such as white ink, is re-dispersed.

In the above-described way, the liquid in the sub tank 42 can be sufficiently agitated.

In FIGS. 5A to 5F, the sub tank 42 includes the communication channel 212 on a bottom end of the partition wall 201*a* disposed between the first container 202A and the second container 202B. The communication channel 212 communicates the liquid between the first container 202A and the second container 202B. Thus, a stagnated liquid settled in the bottom of the sub tank 42 is preferentially passed through the communication channel 212 and is flowed into a circulation flow to be agitated.

Since settled component of the liquid accumulates at the bottom of the sub tank 42, the liquid containing the settled component is preferentially flowed to the communication channel 212. Repetition of generation of the circulation flow and agitation of the liquid moves the stagnated liquid settled at the bottom of the liquid container 202 upward to an upper part of the liquid container 202. Further, a supernatant liquid collected on the upper part of the liquid container 202 moves to the bottom of the liquid container 202.

Thus, the liquid in the sub tank 42 is circulated and agitated in a vertical direction as illustrated in FIGS. 5B to 5E.

Conversely, if the liquid in the sub tank 42 is circulated and moved in a lateral direction, only the supernatant liquid above the stagnated liquid is circulated and moved so that the liquid in the sub tank 42 is poorly agitated.

Figure 5F:
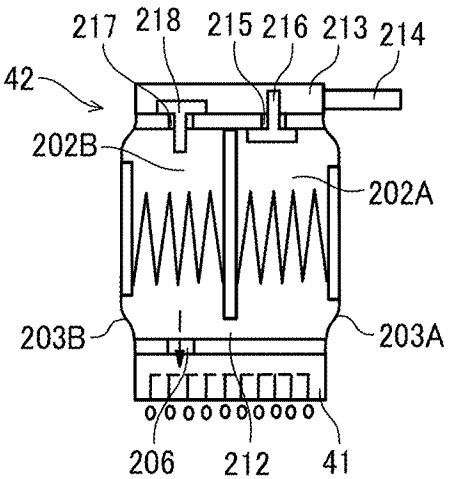

When the head 41 is driven to discharge the liquid, the liquid is supplied from the second container 202B of the sub tank 42 to the head 41 via the head supply port 206 as illustrated in FIG. 5F.

The liquid in the second container 202B is a liquid passed through the communication channel 212 or is a liquid agitated by a liquid feeding pressure from the agitation channel 213. Thus, the sub tank 42 can improve the discharge property of the head 41.

Figure 6A:
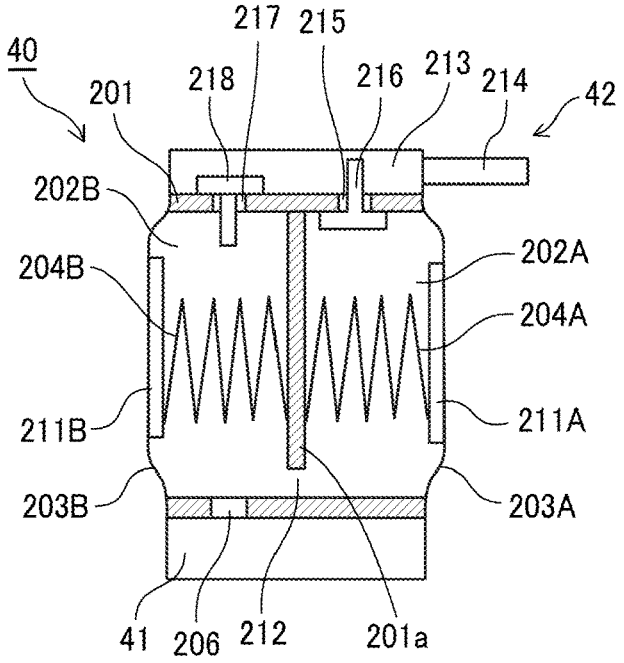
FIGS. 6A and 6B are schematic cross-sectional side views of the discharge device including the sub tank according to a second embodiment of the present disclosure.
Figure 6B:
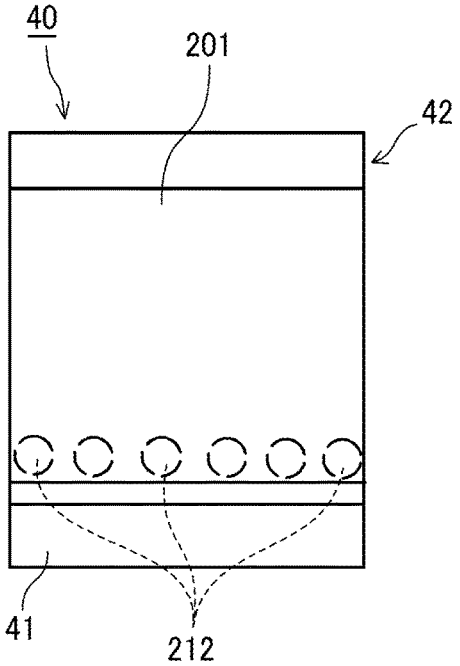

Next, a sub tank 42 (liquid container) according to a second embodiment of the present disclosure is described with reference to FIG. 6. FIGS. 6A and 6B are schematic cross-sectional side views of the discharge device 40 including the sub tank 42 according to the second embodiment of the present disclosure. FIG. 6A is a schematic side view of the discharge device 40 including the sub tank 42. FIG. 6B is a schematic front view of the discharge device 40 including the sub tank 42.

The sub tank 42 according to the second embodiment includes a plurality of communication channels 212 that communicates the first container 202A and the second container 202B with each other. The plurality of communication channel 212 is formed on a lower end (bottom end) of the partition wall 201*a* in the tank case 201. The plurality of communication channels 212 is a plurality of through holes formed in the partition wall 201*a* such that the plurality of communication channels 212 are arrayed in one line in a horizontal direction.

Thus, the partition wall 201*a* includes a plurality of through holes as the communication channel 212.

Thus, the circulation flow flows all over an entire bottom surface of the first container 202A and the second container 202B so that the liquid in the sub tank 42 is fully agitated.

Figure 7A:
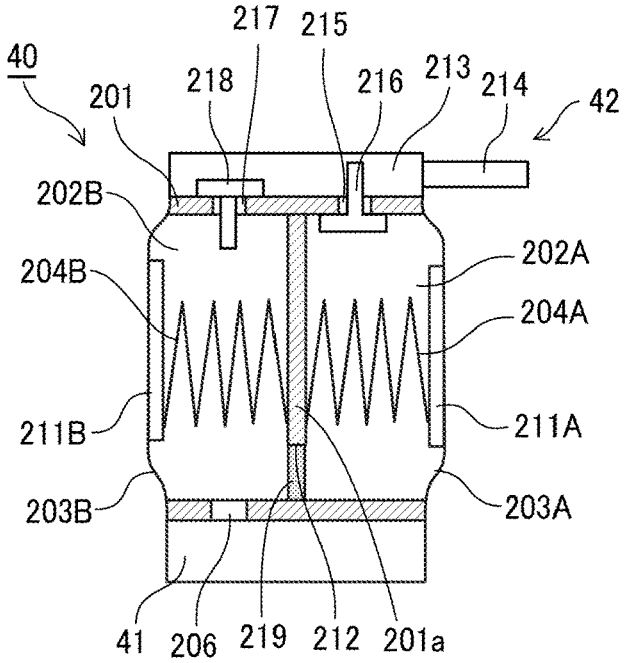
FIGS. 7A and 7B illustrate the discharge device including the sub tank according to a third embodiment of the present disclosure.
Figure 7B:
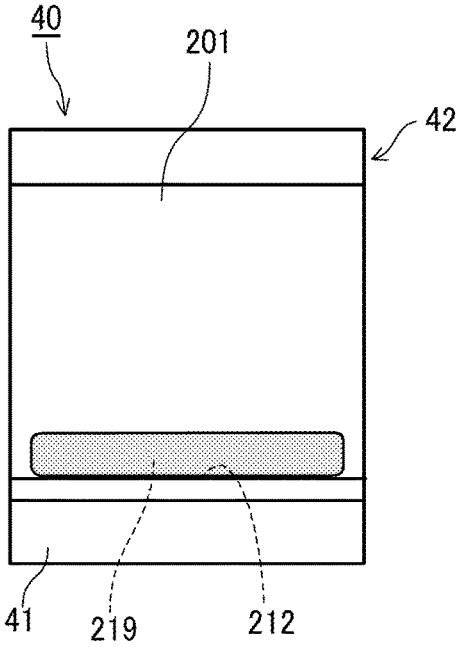

Next, a sub tank 42 (liquid container) according to a third embodiment of the present disclosure is described with reference to FIG. 7. FIGS. 7A and 7B illustrate the discharge device 40 including the sub tank 42 according to the third embodiment of the present disclosure. FIG. 7A is a schematic side view of the discharge device 40 including the sub tank 42 according to the third embodiment of the present disclosure. FIG. 7B is a schematic front view of the discharge device 40 including the sub tank 42 according to the third embodiment of the present disclosure.

The sub tank 42 according to the third embodiment includes a filter 219 having a mesh-like shape, for example, in the communication channel 212 that communicates the first container 202A and the second container 202B.

Thus, the sub tank 42 can further disperse and agitate the stagnated liquid. Further, the mesh-like filter 219 is used to increase a flow velocity of the liquid passing through the filter 219 and further improve agitation of the liquid in the sub tank 42.

Figure 8:
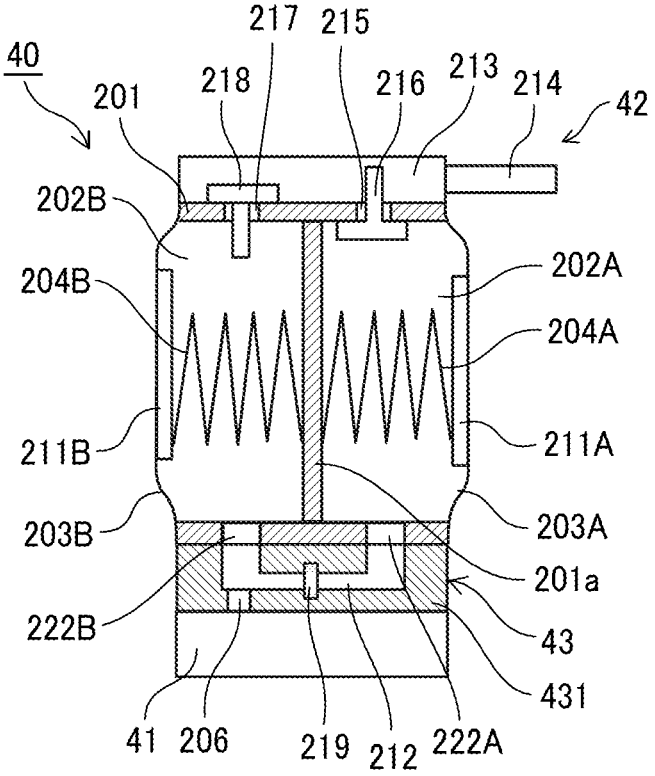
FIG. 8 is a schematic cross-sectional side view of the discharge device including the sub tank according to a fourth embodiment of the present disclosure.

Next, a sub tank 42 (liquid container) according to a fourth embodiment of the present disclosure is described with reference to FIG. 8. FIG. 8 is a schematic cross-sectional side view of the discharge device 40 including the sub tank 42 according to the fourth embodiment of the present disclosure.

The sub tank 42 according to the fourth embodiment includes a communication channel part 43. The communication channel part 43 is separated from the tank case 201 of the sub tank 42 so that the communication channel part 43 is detachably attached to the tank case 201 of the sub tank 42. The communication channel part 43 includes the communication channel 212 that communicates the first container 202A and the second container 202B.

The communication channel part 43 includes an opening 222A (channel), an opening 222B (channel), and the communication channel 212 in a main body 431 of the communication channel part 43. The opening 222A (channel) is formed at a bottom part of the first container 202A of the tank case 201. The opening 222B (channel) is formed at a bottom part of the second container 202B of the tank case 201. The communication channel 212 communicates the opening 222A and the opening 222B. The communication channel part 43 includes a filter 219 in the communication channel 212.

Further, the main body 431 of the communication channel part 43 includes the head supply port 206 to supply a liquid to the head 41. The head supply port 206 is disposed closer to the second container 202B (left side in FIG. 8) than the filter 219 in the communication channel 212 in the lateral direction as illustrated in FIG. 8.

The communication channel part 43 is replaceably (exchangeably) connected to a bottom part of the tank case 201 of the sub tank 42.

The head 41, the communication channel part 43, and the sub tank 42 form the discharge device as a single unit.

Thus, when a solid content of sediment in the liquid adheres to the filter 219 and disturbs the circulation flow of the liquid, the sub tank 42 can replace (exchange) only the communication channel part 43 including the filter 219. Thus, the sub tank 42 according to the fourth embodiment has a longer life than the sub tank 42 according to the first embodiment to the third embodiment.

Figure 9:
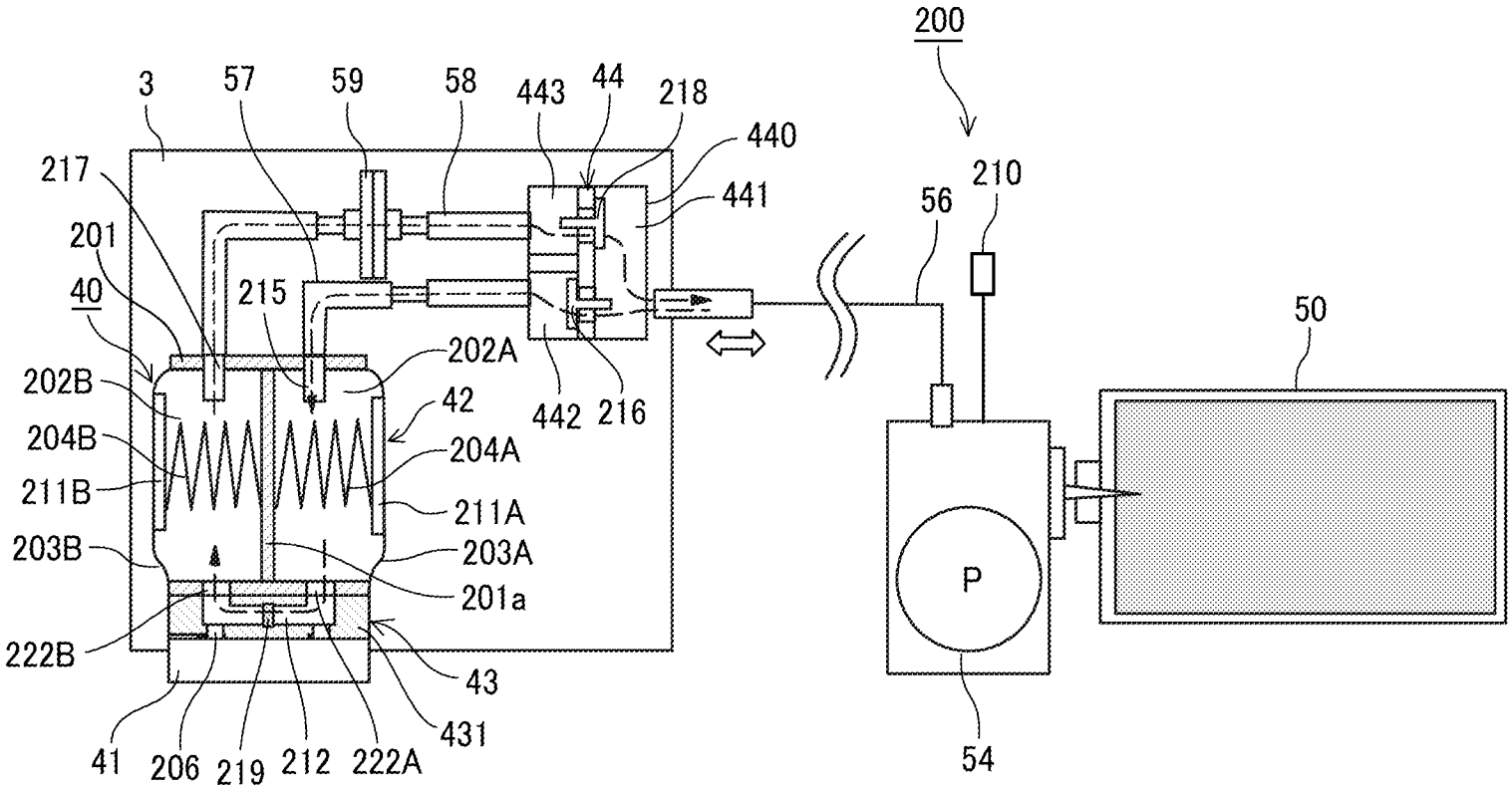
FIG. 9 is a cross-sectional side view of the liquid supply system of the liquid discharge apparatus according to a fifth embodiment of the present disclosure.

Next, the liquid supply system 200 of the liquid discharge apparatus 1000 according to a fifth embodiment of the present disclosure is described with reference to FIG. 9. FIG. 9 is a cross-sectional side view of the liquid supply system 200 according to the fifth embodiment of the present disclosure.

The sub tank 42 includes two liquid containers 202 to store liquids in the tank case 201. The tank case 201 is a main body of the liquid container. The liquid containers 202 include a first container 202A and a second container 202B.

The tank case 201 includes openings on both sides (left side and right side in FIG. 4) and a partition wall 201*a* in a center of the tank case 201, Each opening of the tank case 201 is sealed with a flexible film 203 serving as a flexible member. The flexible film 203 includes a flexible film 203A and a flexible film 2038.

Thus, the tank case 201 includes the first container 202A and the second container 202B, one surface of which is formed of the flexible films 203A and 203B, respectively. The partition wall 201*a* separates the tank case 201 into the first container 202A and the second container 202B.

A restoring force of the negative-pressure forming spring 204 as an elastic member in the tank case 201 constantly pushes each flexible film 203 outward of the tank case 201. The sub tank 42 further includes reinforcement members 211A and 211B to respectively receive one end of negative-pressure forming springs 204A and 204B. The reinforcement members 211A and 211B are respectively fixed to the flexible films 203A and 203B.

Further, the sub tank 42 includes a communication channel part 43 including the communication channel 212 that communicates the first container 202A and the second container 202B of the sub tank 42. The communication channel part 43 is formed separately from the sub tank 42 so that the communication channel part 43 is detachably attachable (replaceable) to the sub tank 42.

The communication channel part 43 includes an opening 222A (channel), an opening 222B (channel), and the communication channel 212 in a main body 431 of the communication channel part 43. The opening 222A (channel) is formed at a bottom part of the first container 202A of the tank case 201 of the sub tank 42. The opening 222B (channel) is formed at a bottom pan of the second container 202B of the tank case 201 of the sub tank 42. The communication channel 212 communicates the opening 222A and the opening 222B. The communication channel part 43 includes a filter 219 in the communication channel 212.

Further, the main body 431 of the communication channel part 43 includes the head supply port 206 to supply a liquid to the head 41. The head supply port 206 is disposed closer to the second container 202B (left side in FIG. 8) than the filter 219 in the communication channel 212 in the lateral direction as illustrated in FIG. 8.

The head 41, the communication channel part 43, and the sub tank 42 form the discharge device 40 as a single unit in the liquid discharge apparatus 1000 according to the fifth embodiment of the present disclosure.

Further, the liquid discharge apparatus 1000 includes a valve 44 between the sub tank 42 and the main tank 50, The valve 11 is separated from the sub tank 42. The valve 44 is connected to the main tank 50 via a liquid path 56. The valve 44 is connected to the first container 202A of the sub tank 42 via a supply path 57. The valve 44 is connected to the second container 202B of the sub tank 42 via a collection path 58.

The valve 44 includes a common channel 441, a supply channel 442, and a collection channel 443 in a unit main body 440. The common channel 441 communicates with the main tank 50 via the liquid path 56. The supply channel 442 communicates with the first container 202A of the sub tank 42 via the supply path 57. The collection channel 443 communicates with the second container 202B of the sub tank 42 via the collection path 58. The collection path 58 includes a filter 59 arranged between the valve 44 and the second container 202B.

The valve 44 includes a first valve 216 and a second valve 218. The first valve 216 opens when a liquid is supplied from the common channel 441 to the first container 202A of the sub tank 42. The second valve 218 opens when the liquid is collected from the second container of the sub tank 42 to the common channel 441 of the valve 44.

When the controller 210 drives the liquid feed pump 54 in the reverse direction, the valve 44 thus configured can close the first valve 216 and open the second valve 218 as illustrated in FIGS. 5B and 5C in the first embodiment. Thus, the liquid in the second container 2028 is transferred to the liquid path 56 via the discharge port 217, the collection path 58, the collection channel 443, and the common channel 441.

When the controller 210 drives the liquid feed pump 54 in the reverse direction to continue a reverse suction from a state in which the liquid is transferred to the liquid path 56 as described above, the liquid in the first container 202A is transferred to the second container 202B via the communication channel 212. Then, the liquid is further transferred from the second container 202B to the liquid path 56 via the discharge port 217, the collection path 58, the collection channel 443, and the common channel 441 as described above.

Then, the controller 210 drives the liquid feed pump 54 in the forward direction to transfer the liquid from the main tank 50 to the common channel 441, so that the first valve 216 opens and the second valve 218 closes. Thus, the liquid is transferred to the first container 202A via the common channel 441, the supply channel 442, supply path 57, and the supply port 215.

When the controller 210 continuously drives the liquid feed pump 54 in the forward direction to further transfer the liquid from a state, in which the liquid is transferred to the first container 202A, the liquid in the first container 202A is transferred to the second container 202B via the communication channel 212.

The above-described operations are repeated once or a plurality of times, so that a liquid, in which sedimented components of the liquid has settled on each bottom of the first container 202A and the second container 202B in the sub tank 42 such as white ink, is re-dispersed.

In the above-described way, the liquid in the sub tank 42 can be sufficiently agitated.

Further, the sub tank 42 in the fifth embodiment includes the valve 44 separated from the sub tank 42. The valve 44 is replaceable (detachable) as a single unit from the liquid supply system 200 so that the valve 44 can increase life of the liquid discharge apparatus 1000.

Thus, replacement (detachment) of the filter 59 from the collection path 58 can remove foreign matter in the filter 59 during a liquid circulation process. Further, the liquid supply system 200 includes a replaceable (detachable) filter 59 in the collection path 58 between the sub tank 42 and the valve 11 so that foreign matter is removable during the liquid circulation process.

Further, the valve 44, the supply path 57, the collection path 58, the filter 59, the sub tank 42, the head 41, and the like are mounted and fixed on the carriage 3. Thus, a tube that slides with a scanning movement of the carriage 3 is only a tube that constitutes the liquid path 56. As described above, there is no tube that slides during the liquid circulation process in the liquid supply system 200. Thus, the liquid supply system 200 according to the fifth embodiment can stabilize a movement (behavior) of the carriage 3 and stabilize a liquid discharge operation of the head 41.

Figure 10:
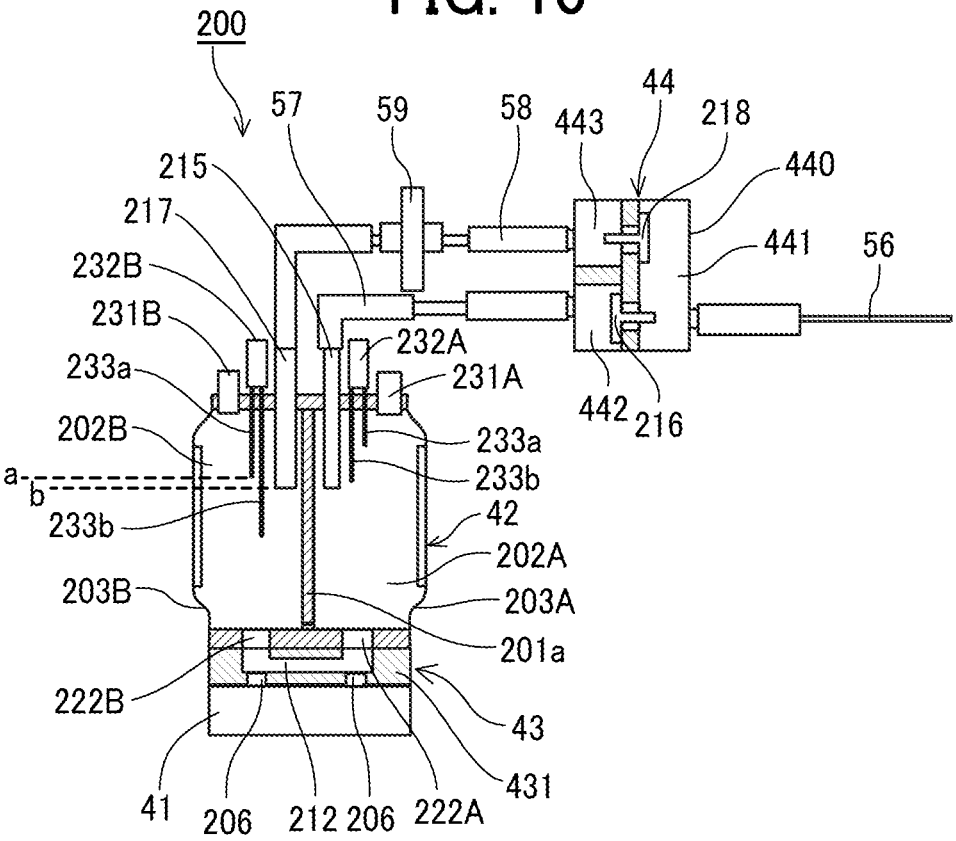
FIG. 10 is a schematic side view of the liquid supply system including the sub tank according to a sixth embodiment of the present disclosure.

Next, a liquid supply system 200 of a liquid discharge apparatus 1000 according to a sixth embodiment of the present disclosure is described with reference to FIG. 10. FIG. 10 is a schematic view of the liquid supply system including the sub tank 42 according to the sixth embodiment of the present disclosure.

The sub tank 42 according to the sixth embodiment includes air release valves 231 (231A and 231B) as an air release mechanism. The air release valve 231A and 231B are collectively referred to as air release valves 231. The air release valves 231A and 232B respectively open the first container 202A and the second container 202B to atmosphere (air outside the sub tank 42).

Further, the sub tank 42 includes liquid level detection sensors 232 (232A and 232B). The liquid level detection sensors 232A and 232B respectively detect liquid levels 300 (see FIGS. 12A and 12B) of the first container 202A and the second container 202B. The sub tank 42 includes liquid level detection sensors 232A and 232B, to each of which two electrode pins 233*a* and 233*b* having different lengths are attached.

Since liquid has electric conductivity, when the liquid level 300 reaches the electrode pins 233*a* and 233*b*, electric current flows between the electrode plus 233*a* and 233*b* and the resistance values of the electrode pins 233*a* and 233*b* change. Thus, the liquid discharge apparatus 1000 having such a configuration can detect that the liquid level 300 increased or decreased to a predetermined height (height of the electrode pin 233*a*), an amount of air in the liquid container 202 increased to a predetermined amount, and the like.

Here, a height "a" of a lower end of the electrode pin 233*a* of the liquid level detection sensor 232B is higher than a height "b" of the discharge port 217 of the second container 202B. Further, a height of the electrode pin 233*a* of the liquid level detection sensor 232A is higher than a height a of the electrode pin 233*a* of the liquid level detection sensor 232B.

Figure 11:
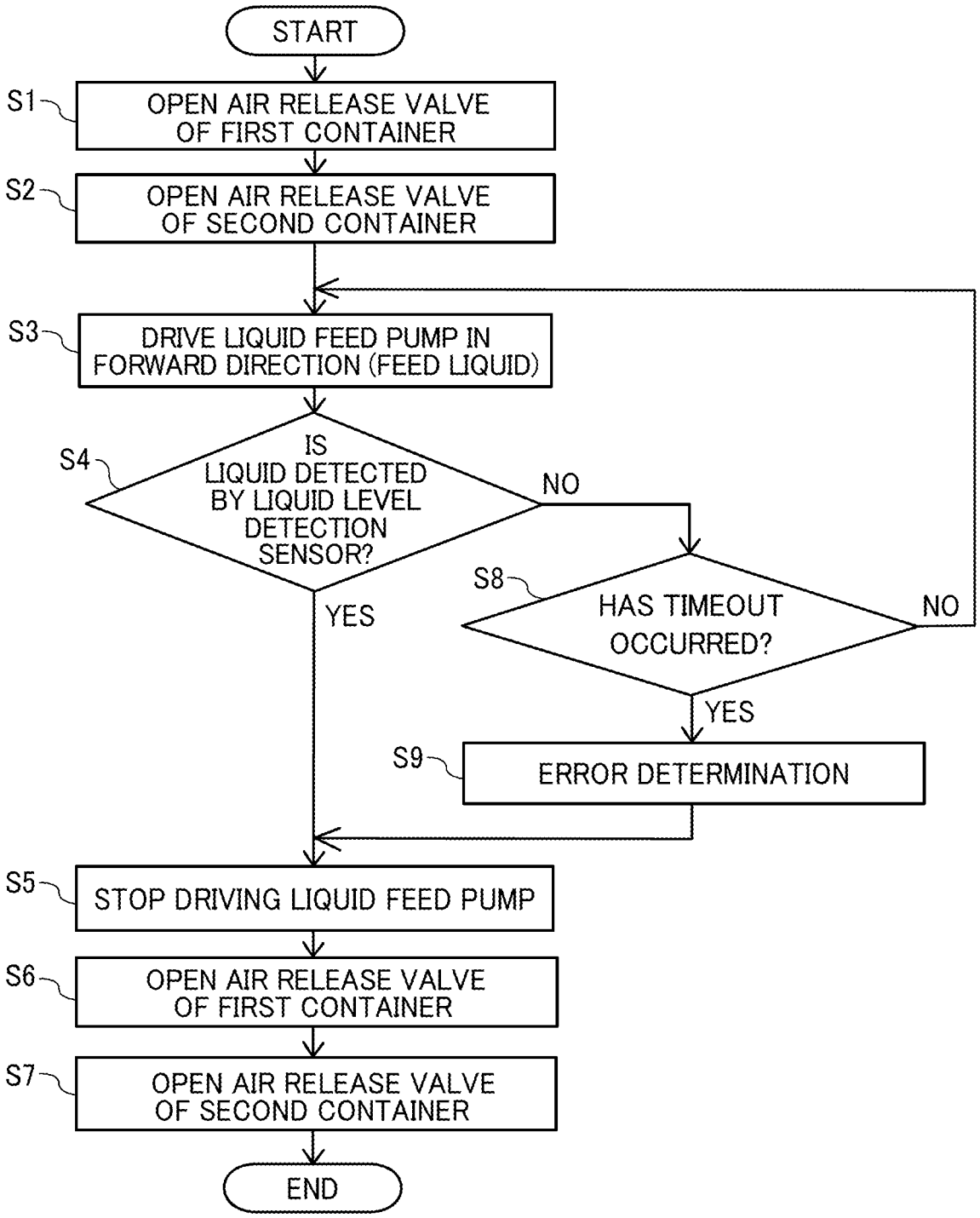
FIG. 11 is a flowchart illustrating the liquid filling operation to the sub tank according to the sixth embodiment of the present disclosure.
Figure 12B:
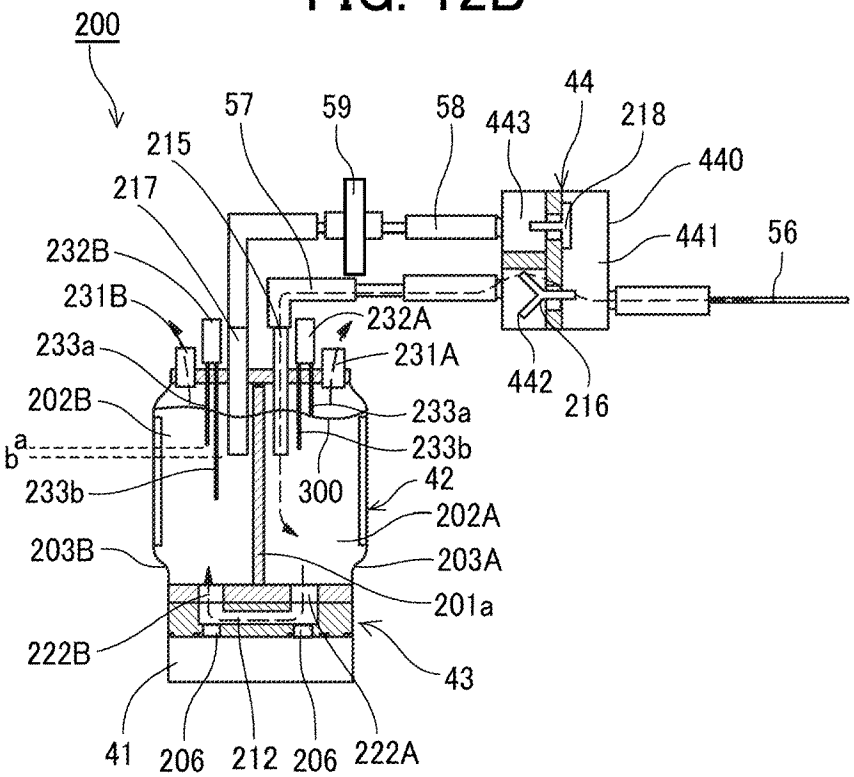
FIGS. 12A and 12B are schematic cross-sectional side views of the liquid supply system including the sub tank according to the sixth embodiment of the present disclosure.
Figure 12A:
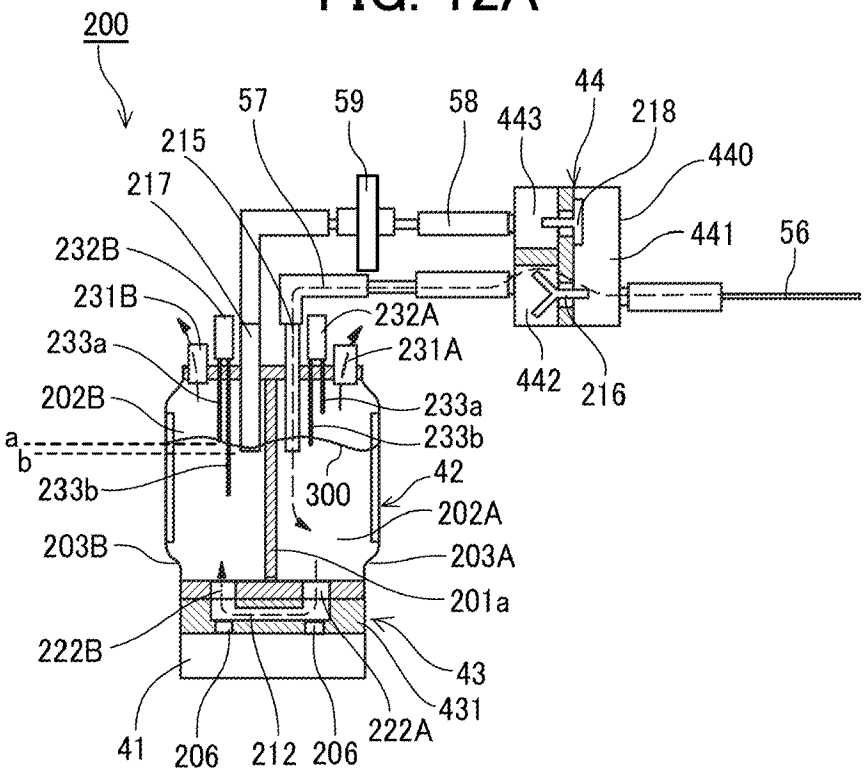

Next, a liquid filling operation of the sub tank 42 according to the sixth embodiment of the present disclosure is described with reference to FIG. 11 and FIGS. 12A and 128. FIG. 11 is a flowchart illustrating the liquid tilling operation to the sub tank 42 according to the sixth embodiment of the present disclosure, FIGS. 12A and 12B are schematic cross-sectional side views of the liquid supply system 200 including the sub tank 42.

First, the air release valve 231A of the first container 202A opens to open the first container 202A to the atmosphere (step S1, "OPEN VALVE"). Hereinafter, the step S1 is simply referred tows "S1." Next, the air release valve 231B of the second container 202B opens to open the second container 202B to the atmosphere (S2, "OPEN VALVE").

Then, the controller 210 drives the liquid feed pump 54 in the forward direction to feed the liquid from the main tank 50 to the sub tank 42 (S3, "LIQUID FEED"). At the time of the step S3, the first valve 216 of the valve 44 opens, the second valve 218 closes, and the liquid is fed from the main tank 50 to the first container 202A of the sub tank 42 as illustrated in FIG. 12A.

Thus, the liquid level 300 of the first container 202A and the second container 202B increases. Since the air release valves 231A and 231B are open, the liquid level 300 of the first container 202A and the liquid level 300 of the second container 202B become substantially the same height.

Then, it is determined that whether the liquid level detection sensor 232A of the first container 202A detects the liquid level liquid surface) 300 in the first container 202A.

As illustrated in FIG. 12B, when the liquid level 300 in the first container 202A reaches the electrode pin 233*a* and the liquid level 300 is detected by the liquid level detection sensor 232A of the first container 202A, the controller 210 stops driving the liquid feed pump 54 (S5).

Then, the air release valve 231A of the first container 202A closes (S6), and the air release valve 231B of the second container 202B also closes (S7). Thus, an interior of the sub tank 42 is sealed by closing of the air release valves 231A and 231B.

Conversely, when the liquid level detection sensor 232A does not detect the liquid level 300 in the first container 202A, the controller 210 determines whether a predetermined time has elapsed. That is, the controller 210 determines whether a timeout has occurred (S8). Then, when the timeout has occurred (S8, YES), the controller 210 performs an error determination (S9), and the process proceeds to step S5.

Figure 13:
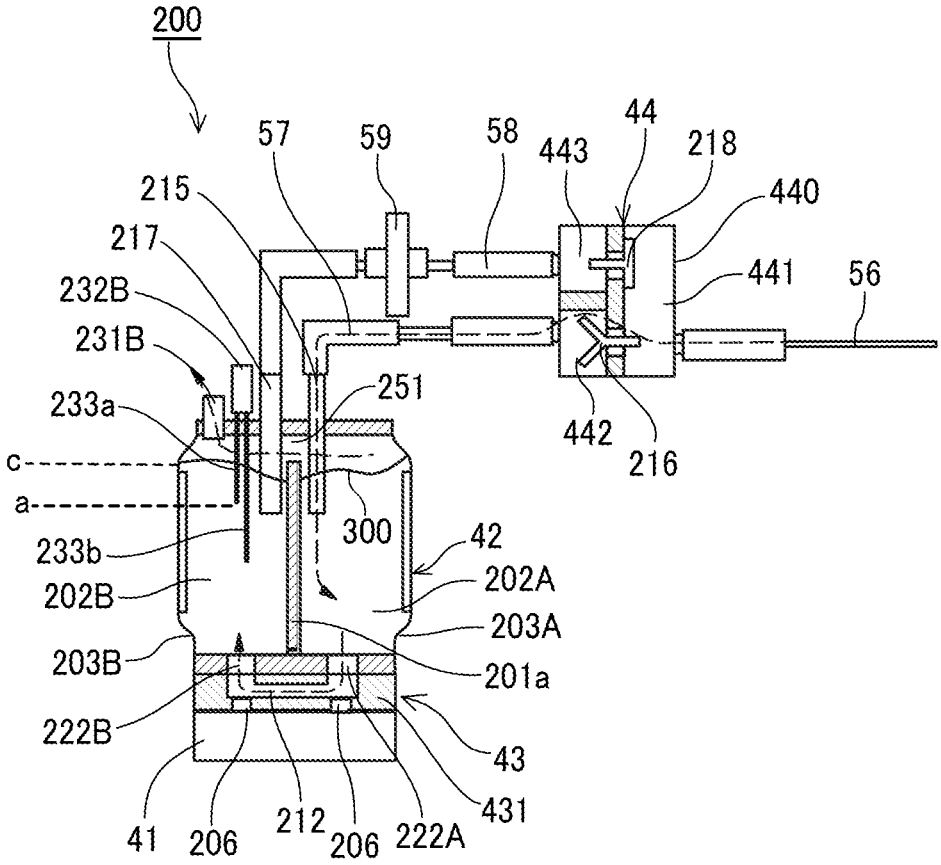
FIG. 13 is a schematic side view of the liquid supply system including the sub tank according to a seventh embodiment of the present disclosure.

Next, a liquid supply system 200 of a liquid discharge apparatus 1000 according to a seventh embodiment of the present disclosure is described with reference to FIG. 13. FIG. 13 is a schematic side view of the liquid supply system 200 including the sub tank 42 according to the seventh embodiment of the present disclosure.

The sub tank 42 according to the seventh embodiment includes air release valve 231B and liquid level detection sensor 232B. The air release valve 231B opens the second container 202B to the atmosphere (air outside the sub tank 42). The liquid level detection sensor 232B detects the liquid level 300 in the second container 202B. The sub tank 42 does not include the air release valve 231A and a liquid level detection sensor 232A (see FIG. 12A) in the first container 202A as illustrated in FIG. 13.

On the other hand, the sub tank 42 includes an air communication channel 251 on an upper part of the partition wall 201*a* that separates the first container 202A and the second container 202B. Thus, opening of the air release valve 231B opens the first container 202A and the second container 202B.

Figure 14:
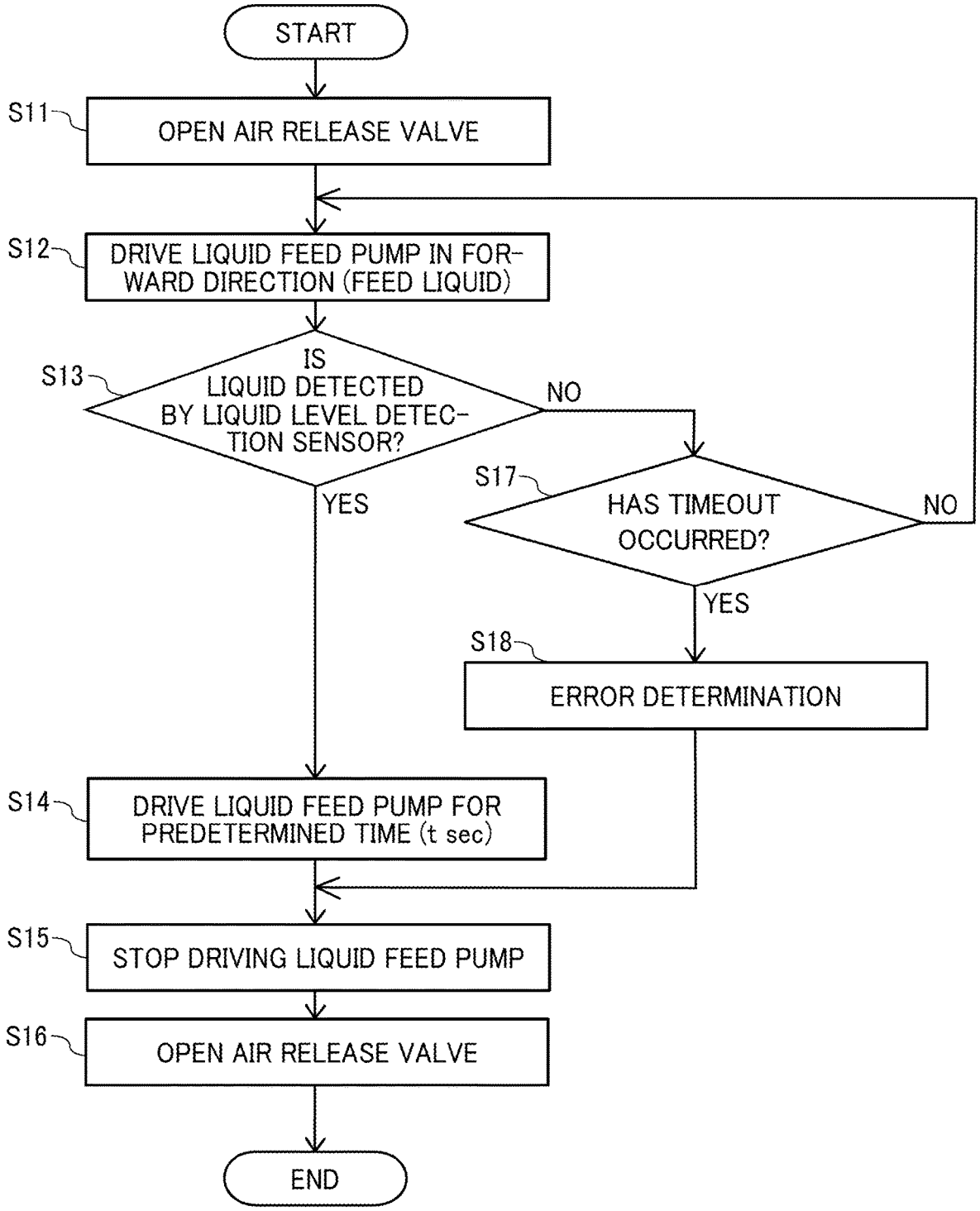
FIG. 14 is a flowchart illustrating the liquid filling operation to the sub tank according to the seventh embodiment of the present disclosure.

Next, a liquid filling operation of the sub tank 42 according to the seventh embodiment of the present disclosure is described with reference to FIG. 14. FIG. 14 is a flowchart illustrating the liquid filling operation to the sub tank 42 according to the seventh embodiment of the present disclosure.

Next, the air release valve 231B of the second container 202B opens to open the first container 202A and the second container 202B to the atmosphere (S11, "OPEN VALVE").

Then, the controller 210 drives the liquid feed pump 54 in the forward direction to feed the liquid from the main tank 50 to the sub tank 42 (S12, "LIQUID FEED"). At the time of the step S12, the first valve 216 of the valve 44 opens, the second valve 218 closes, and the liquid is fed from the main tank 50 to the first container 202A of the sub tank 42 as in the first embodiment as described above.

Thus, the liquid level 300 of the first container 202A and the second container 202B increases. Since the air release valves 231A and 231B open, the liquid level 300 of the first container 202A and the liquid level 300 of the second container 202B become substantially the same height.

Then, the controller 210 determines whether the liquid level detection sensor 232B of the second container 202B detects the liquid level 300 (liquid surface) in the second container 202B (S13).

Then, the controller 210 drives the liquid feed pump 54 for the predetermined time "t" when the liquid level detection sensor 232B of the second container 202B detects the liquid level 300 (liquid surface) in the second container 202B (S14). Thus, the liquid level 300 becomes a height "c" that is higher than the height "a" of the liquid level detection sensor 232B by a supply amount of liquid fed for a predetermined time "t". The controller 210 may stop the liquid feed pump 54 at a height "a" detected by the liquid level detection sensor 232B.

After the controller 210 drives the liquid fed pump 54 for a predetermined time "t", the controller 210 stops driving the liquid feed pump 54 (S15) and closes the air release valve 231B of the second container 202B (S16). Thus, an interior of the sub tank 42 is sealed by closing of the air release valves 231A and 231B.

Conversely, the controller 210 determines whether a predetermined time has elapsed, that is, determines whether the timeout has occurred (S17) when the liquid level detection sensor 232B does not detect the liquid level 300 in the second container 202B. Then, when the timeout has occurred (S17, YES), the controller 210 performs an error determination (S18), and the process proceeds to step S15.

Figure 15C:
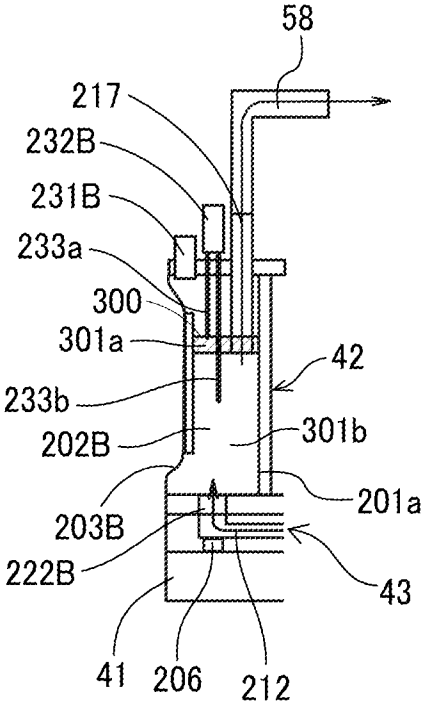
FIGS. 15A to 15C are cross-sectional side views of a second container of the sub tank illustrating an agitation operation in the liquid discharge apparatus according to an eighth embodiment of the present disclosure.
Figure 15B:
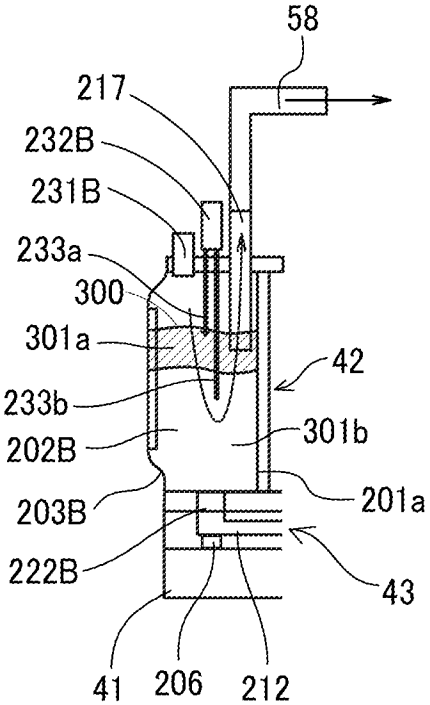
Figure 15A:
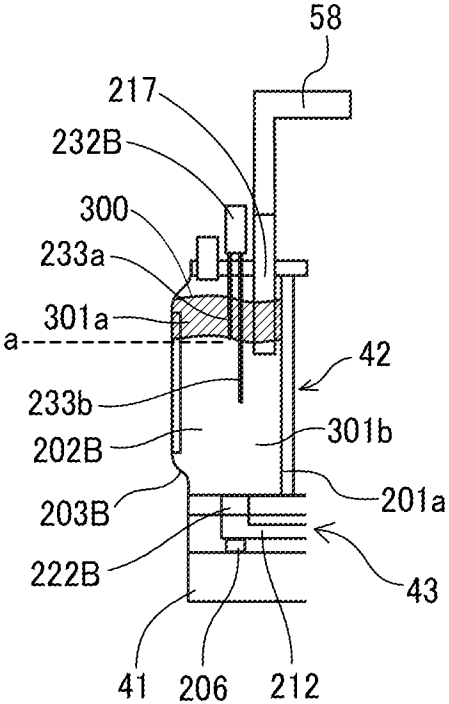

Next, a liquid discharge apparatus 1000 according to an eighth embodiment of the present disclosure with reference to FIGS. 15A to 15C. FIGS. 15A to 15C are cross-sectional side views of the second container 202B of the sub tank 42 illustrating a liquid agitation operation in the liquid discharge apparatus 1000 according to the eighth embodiment of the present disclosure.

Since a configuration of the liquid supply system including the sub tank 42 according to the eighth embodiment is the same as the configuration according to the sixth embodiment or the seventh embodiment, the description of the liquid supply system is omitted below.

In FIG. 15A, the liquid in the sub tank 42 is in a state in which the sedimented component is settled on a bottom of the sub tank 42 with time, and the liquid is separated into a supernatant liquid 301*a* and a stagnant liquid 301*b* (precipitation liquid).

Thus, in FIG. 15A, the supernatant liquid 301*a* at a water level higher than the discharge port 217 of the second container 202B cannot be sufficiently sucked from the discharge port 217 to be reversely fed to the collection path 58 even when the controller 210 drives the liquid feed pump 54 in the reverse direction to sucked the liquid in the second container 202B.

The sub tank 42 according to the eighth embodiment includes the electrode pin 233*a* of the liquid level detection sensor 232B to detect a liquid level 300 at the same height as a height of the discharge port 217 of the second container 202B or a liquid level 300 slightly higher than the height of the discharge port 217. Thus, a height of the liquid level 300 in the second container 202B detected by the liquid level detection sensor 232B is equal to or higher than the height of the discharge port 217.

Thus, as illustrated in FIG. 15A, the controller 210 opens the air release valve 231B as illustrated in FIG. 15B when the sedimented component in the liquid in the sub tank 42 is settled on a bottom of the sub tank 42 with time and the liquid is separated into the supernatant liquid 301*a* and the stagnant liquid 301*b* (precipitation liquid).

Then, the controller 210 drives the liquid feed pump 54 in the reverse direction to suck the liquid in the second container 202B from the discharge port 217 and discharge the sucked liquid to the main tank 50 via the discharge port 217, the agitation channel 213 and liquid path 56. Then, air flows in through the air release valve 231B so that the liquid level 300 of the liquid in the second container 202B is lowered.

Then, as illustrated in FIG. 15C, the controller 210 closes the air release valve 231B when the liquid level detection sensor 232B of the second container detects the liquid level 300 of the liquid in the second container 202B. Then, the controller 210 drives the liquid feed pump 54 in the reverse direction to suck the liquid from the second container 202B.

Since the controller 210 closes the air release valve 231B to seal an interior of the sub tank 42, even if the liquid is sucked by the liquid feed pump 54, the liquid level 300 of the liquid in the second container 202B does not drop and the flexible film 203B contracts inward (rightward in FIG. 15C). Thus, the supernatant liquid 301*a* near the discharge port 217 is sucked from the discharge port 217 and discharged to the collection path 58 outside the second container 202B.

Thus, the sub tank 42 according to the eighth embodiment can circulate the supernatant liquid 301*a* having a water level higher than the height of the discharge port 217 of the second container 202B and can keep the liquid in an appropriate state by circulation and agitation.

Figure 16:
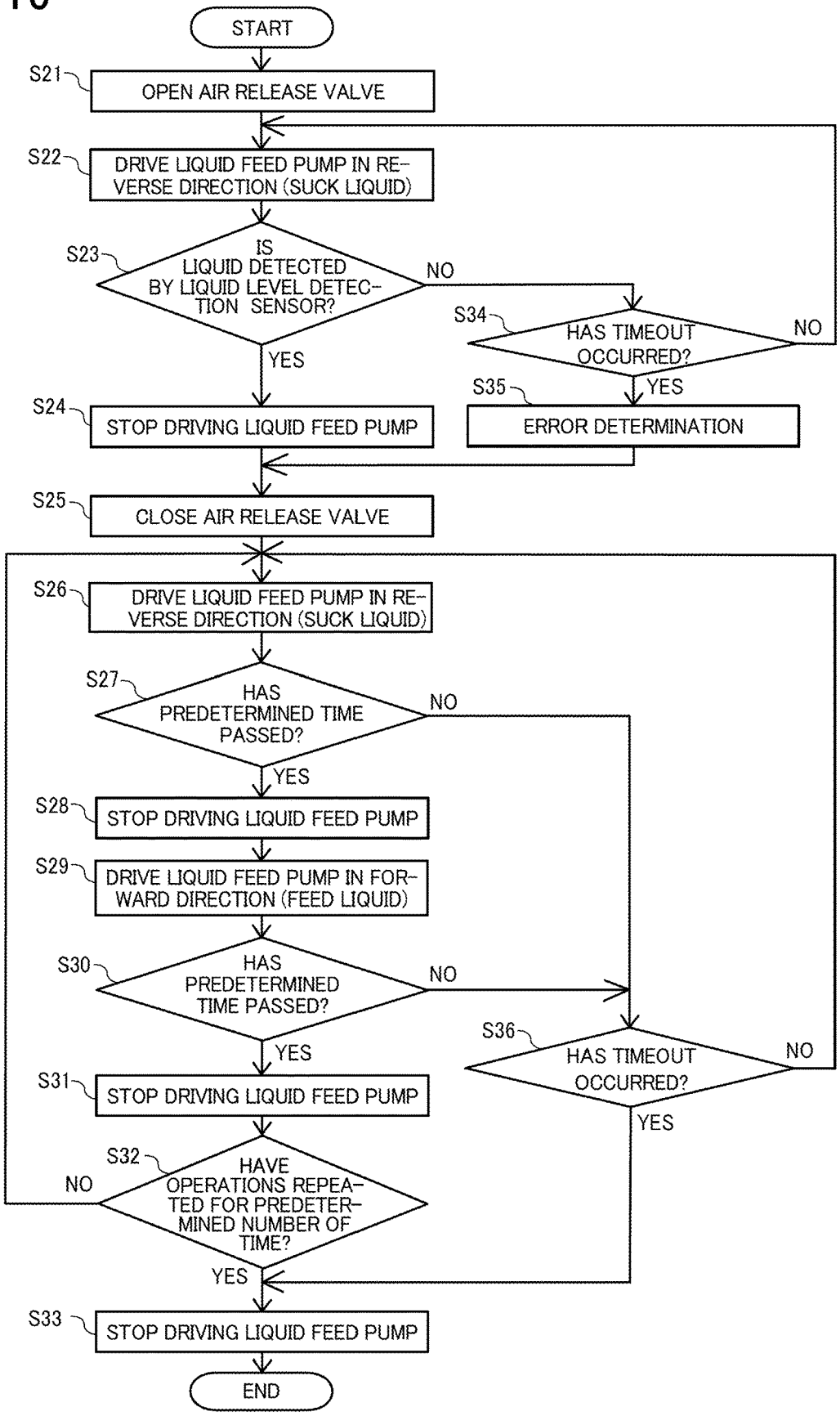
FIG. 16 is a flowchart illustrating a control of the agitation operation of the sub tank according to the eighth embodiment of the present disclosure.

FIG. 16 is a flowchart illustrating a control of an agitation operation of the sub tank 42 according to the eighth embodiment of the present disclosure.

The controller 210 opens the air release valve 231B of the second container 202B to open the first container 202A and the second container 202B to the atmosphere (S21).

Then, the controller 210 drives the liquid feed pump 54 in the reverse direction to suck the liquid from the sub tank 42 to the main tank 50 (S22, "SUCK LIQUID"). At the time of the step S22, the first valve 216 of the valve 44 closes, the second valve 218 of the valve 44 opens, and the liquid is reversely fed from to the second container 202B of the sub tank 42 to the liquid path 56 via the collection path 58, and the collection channel 443 and the common channel 441 in the valve 44.

Then, the controller 210 determines whether the liquid level detection sensor 232B detects the liquid level 300 (liquid surface) of the liquid in the second container 202B (S24).

In the step S24, if the liquid level detection sensor 232B detects the liquid level 300 of the liquid in the second container 202B, the controller stops driving the liquid feed pump 54 (S24) and closes the air release valve 231B to seal the interior of the sub tank 42 (S25).

Then, the controller 210 drives the liquid feed pump 54 in the reverse direction to suck the liquid from the sub tank 42 to the main tank 50 (S26, "SUCK LIQUID").

Then, the controller 210 determines whether a predetermined time has passed after a start of a liquid feed in the reverse direction (S27), In the step S27, instead of determination of a passage of the predetermined time, the controller 210 may control the displacement detector 220 to detect the flexible film 203B to determine whether the flexible film 203B has reached a negative pressure lower limit position that is a position of the flexible film 203B at a negative pressure lower limit of the sub tank 42. That is, the controller 210 controls an operation of the liquid feed pump 54 according to a suction time corresponding to a liquid suction amount allowable by a negative pressure in the sub tank 42 or a displacement amount of the flexible film 203.

Then, when a predetermined time has passed or when the displacement detector 220 detects that the flexible film 203B has reached the negative pressure lower limit position, the controller 210 stops driving the liquid feed pump 54 (S28).

Then, the controller 210 drives the liquid feed pump 54 in the forward direction to feed the liquid from the main tank 50 to the sub tank 42 ("FEED LIQUID", S29). An operation of feeding the liquid from the main tank 50 to the sub tank 42 is also referred to as a liquid feed operation.

Then, the controller 210 determines whether a predetermined time has passed after a start of a liquid feed in the forward direction (S30). In the step S30, instead of determination of a passage of the predetermined time, the controller 210 may control the displacement detector 220 to detect the flexible film 203B to determine whether the flexible film 203B has reached the negative pressure lower limit position. That is, the controller 210 controls an operation of the liquid feed pump 54 according to a suction time corresponding to a liquid feed amount allowable by a negative pressure in the sub tank 42 or a displacement amount of the flexible film 203.

Then, when a predetermined time has passed or when the displacement detector 220 detects that the flexible film 203B has reached the negative pressure lower limit position, the controller 210 stops driving the liquid feed pump 54 (S31).

Then, the controller 210 determines whether the above-described operations has been repeated for a predetermined number of times. When the above-described operations have been repeated for a predetermined number of times, the process returns to step S26 (S32, NO). When the above-described operations have been repeated for the predetermined number of times (S32, YES), the controller 210 stops driving the liquid feed pump 54 (S33). In the step S32, the controller may fill a liquid to the sub tank 42 (liquid filling operation) as described above.

Conversely, the controller 210 determines whether a predetermined time has passed, that is, determines whether the timeout has occurred (S34) when the liquid level detection sensor 232B does not detect the liquid level 300 of the liquid in the second container 202B. Then, when the timeout has occurred, the controller 210 performs an error determination (S35), and the process proceeds to step S25.

Further, in step S27, when the predetermined time has not passed, or when the displacement detector 220 does not detect that the flexible film 203B has reached the negative pressure lower limit position, the controller 210 determines whether the timeout has occurred (S36). Then, when the timeout has occurred (S36, YES), the process proceeds to step S33.

Similarly, in step S27, when the predetermined time has not passed (S27, NO), or when the displacement detector 220 does not detect that the flexible film 203B has reached the negative pressure lower limit position, the controller 210 determines whether the timeout has occurred (S36). Then, when the timeout has occurred (S36, YES), the process proceeds to step S33.

Thus, the controller 210 controls the above-described agitation operation so that the sub tank 42 according to the eighth embodiment can circulate the supernatant liquid 301*a* having a water level higher than the height of the discharge port 217 of the second container 202B.

Figure 17A:
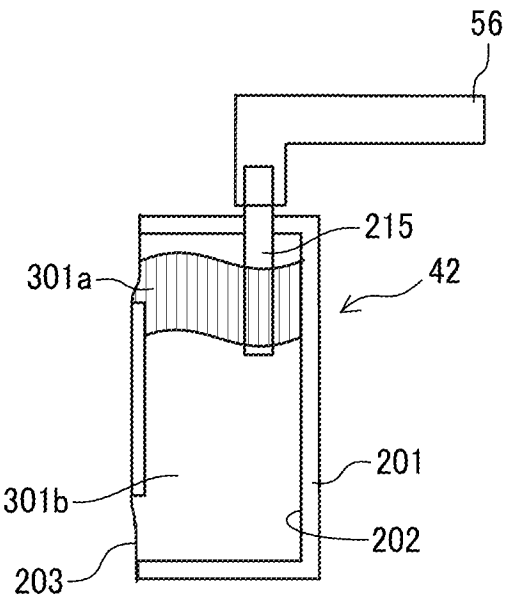
FIGS. 17A to 17C are cross-sectional side views of the sub tank illustrating an agitation state in which a controller drives the white ink feed pump in a forward direction and a reverse direction when the liquid component in the liquid in the sub tank is separated into a supernatant liquid and a stagnant liquid.
Figure 17B:
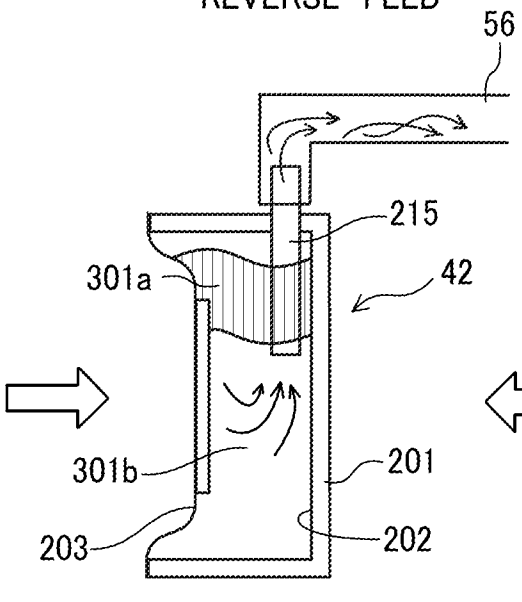
Figure 17C:
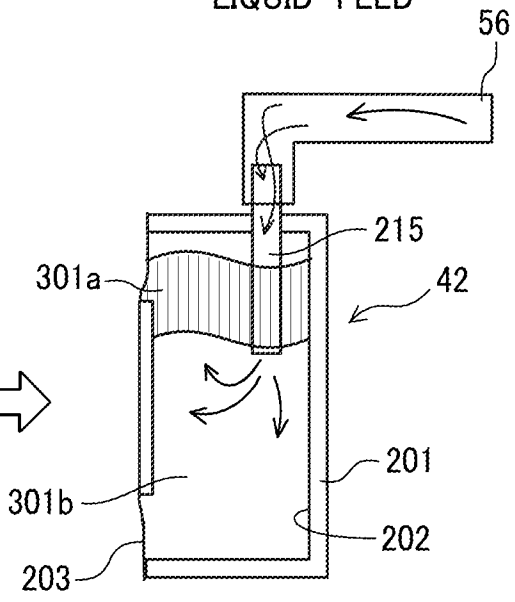

Here, it is described below a limit in a case in which the controller 210 drives the liquid feed pump 54 in the forward and reverse directions to agitate the liquid in the sub tank 42 that stores a liquid containing the sedimented component such as white ink with reference to FIGS. 1 to 17C. FIGS. 17A to 17C are cross-sectional side views of the sub tank 42 illustrating an agitation state in which the controller 210 drives the liquid feed pump 54 in the forward direction and the reverse direction when the liquid component in the liquid in the sub tank 42 is separated into a supernatant liquid 301*a* and a stagnant liquid 301*b*. In FIGS. 17A to 17C, the agitation operation on the supply port 215 side is described below.

When the liquid containing the sedimented component such as white ink is settled over time from a normal liquid state in which no sedimentation has occurred, the liquid is separated into the supernatant liquid 301*a* containing a light liquid component having a light specific gravity and the stagnant liquid 301*b* containing a heavy liquid component having a heavy specific gravity heavier than the light specific gravity as illustrated in FIG. 17A.

Thus, when the liquid component is separated into a plurality of liquids (supernatant liquid 301*a* and stagnant liquid 301*b*) having different characteristics over time or due to changes in the environment, a separation of the liquid may cause a change in characteristics of the liquid discharged from the head 41. The change in the characteristics of the liquid may affect discharge characteristics and print quality.

Before an agitation operation of the interior of the sub tank 42 storing the liquid containing the sedimented component, the liquid in the sub tank 42 is separated to the supernatant liquid 301*a* and the stagnant liquid 301*b*, and the supernatant liquid 301*a* is above the supply port 215 as illustrated in FIG. 17A.

In the above-described separated state, if the liquid feed pump 54 is reversely driven to suck the liquid from the supply port 215, most of the supernatant liquid 301*a* above the supply port 215 cannot be sucked (reversely fed) to the supply port 215 as indicated by "REVERSE FEED" as illustrated in FIG. 17B. An operation of feeding the liquid from the sub tank 42 to the main tank 50 is also referred to as a "reverse feed operation."

If the sucked liquid is fed to the sub tank 42 after the reverse feed operation in FIG. 17B, a liquid feeding flow can be generated below the supply port 215 as illustrated in FIG. 17C. However, the liquid feeding flow cannot agitate the liquid up to the supernatant 301*a* above the supply port 215.

Conversely, the liquid discharge apparatus 1000 is configured as in the sixth embodiment or the seventh embodiment, and the agitation operation is performed as in the eighth embodiment, so that the liquid containing the supernatant liquid 301*a* in the sub tank 42 can be sufficiently agitated.

In the present embodiments, a "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus ma be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate. Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the "liquid discharge apparatus" may be a serial head apparatus that moves the head, a line head apparatus that does not move the head, or the like.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image priming", and "fabricating" used herein may be used synonymously with each other.

Each of the functions of the described embodiments such as the controller 210 (circuitry) may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid container configured to store a liquid to be supplied to a liquid discharge head, the liquid container comprising:

a tank case;

a first container in the tank case, the first container configured to store the liquid;

a second container, separated from the first container, in the tank case, the second container configured to store the liquid;

a communication channel connecting the first container and the second container;

a first valve configured to open when the liquid is fed to the first container;

a second valve configured to open when the liquid is discharged from the second container;

a supply port configured to supply the liquid to the first container;

a discharge port configured to discharge the liquid from the second container:

wherein the first valve is at the supply port to open and close the supply port; and the second valve is at the discharge port to open and close the discharge port.

2. The liquid container according to claim 1, further comprising:

a partition wall separating the first container and the second container, wherein the partition wall includes the communication channel.

3. The liquid container according to claim 2, wherein the communication channel is on a bottom part of the partition wall.

4. The liquid container according to claim 2, wherein the communication channel includes a filter.

5. The liquid container according to claim 2, wherein partition wall includes a plurality of through holes as the communication channel.

6. The liquid container according to claim 1, further comprising:

a communication channel part detachably attached to the tank case, wherein the communication channel part includes the communication channel.

7. The liquid container according to claim 6, wherein the communication channel part is removably connected to a bottom part of the tank case.

8. The liquid container according to claim 6, wherein the communication channel part includes a filter.

9. The liquid container according to claim 1, wherein the second container in the tank case includes a head supply port configured to supply the liquid to the liquid discharge head.

10. The liquid container according to claim 1, further comprising:

a liquid level detection sensor configured to detect a liquid level of the liquid in the second container; and a discharge port configured to discharge the liquid from the second container, wherein a height of the liquid level in the second container detected by the liquid level detection sensor is equal to or higher than a height of the discharge port.

11. The liquid container according to claim 1, further comprising:

an agitation channel on a top part of the tank case, wherein the first container communicates with the agitation channel via the supply port, and the second container communicates with the agitation channel via the discharge port.

12. A liquid discharge device comprising:

a liquid discharge head configured to discharge a liquid; and the liquid container according to claim 1.

13. A liquid discharge apparatus comprising the liquid discharge device according to claim 12.

14. A liquid discharge apparatus comprising:

a liquid discharge head configured to discharge a liquid;

a liquid container configured to store a liquid to be supplied to the liquid discharge head; and a main tank configured to store the liquid to be supplied to the liquid container, wherein the liquid container includes:

a tank case;

a first container in the tank case, the first container configured to store the liquid;

a second container, separated from the first container, in the tank case, the second container configured to store the liquid;

a communication channel connecting the first container and the second container;

a first valve configured to open when the liquid is fed to the first container;

a second valve configured to open when the liquid is discharged from the second container;

a supply port configured to supply the liquid to the first container;

a discharge port configured to discharge the liquid from the second container;

wherein the first valve is at the supply port to open and close the supply port; and the second valve is at the discharge port to open and close the discharge port.

15. The liquid discharge apparatus according to claim 14, further comprising:

a liquid feed pump configured to feed the liquid in a forward direction from the main tank to the liquid container and to feed the liquid in a reverse direction from the liquid container to the main tank; and circuitry configured to control the liquid feed pump:

to feed the liquid in the forward direction from the main tank to the liquid container as a liquid feed operation;

to feed the liquid in the reverse direction from the liquid container to the main tank as a reverse feed operation; and to repeat the liquid feed operation and the reverse feed operation to agitate the liquid in the liquid container.

* * * * *